US005448797A

United States Patent [19]

Coleman

[11] Patent Number: 5,448,797

[45] **Date of Patent: * Sep. 12, 1995**

[54] SELECTABLE FRICTION ASSISTED DOOR HOLDER ASSEMBLY

[75] Inventor: Michael D. Coleman, Indianapolis, Ind.

[73] Assignee: Von Duprin, Inc., Indianapolis, Ind.

[ * ] Notice: The portion of the term of this patent subsequent to Jun. 27, 2012 has been disclaimed.

[21] Appl. No.: 137,865

[22] Filed: Oct. 15, 1993

[51] Int. Cl.[6] ..... E05F 5/00; E05F 5/02

[52] U.S. Cl. ..... 16/85; 16/63; 292/273

[58] Field of Search ..... 16/63–65, 16/35, 49; 292/273, 274, 275, 277; 49/394

[56] References Cited

U.S. PATENT DOCUMENTS

| | | | |
|---|---|---|---|
| 2,049,726 | 8/1936 | Weidner | 292/275 |
| 2,108,891 | 2/1938 | Johnson | 292/275 |
| 3,683,450 | 8/1972 | Morrison et al. | 16/49 |

*Primary Examiner*—S. Thomas Hughes
*Assistant Examiner*—Kenneth J. Hansen
*Attorney, Agent, or Firm*—Robert F. Palermo; A. James Richardson

[57] ABSTRACT

An adjustable overhead mounted door holder assembly for attachment between a door jamb and a door to hold the door in an open position includes a jamb bracket attached to the door jamb and a jamb arm pivotally attached to the jamb bracket. A channel assembly having a longitudinally extending channel is attached to the door, and a spring assisted assembly holds the door in an open position assisted by frictional force. The amount of friction is adjustable by altering a rotational position of an eccentric cam.

10 Claims, 3 Drawing Sheets

SELECTABLE FRICTION ASSISTED DOOR HOLDER ASSEMBLY

BACKGROUND OF THE INVENTION

This invention relates generally to a novel adjustable overhead door holder assembly and, more particularly, to a friction adjusted overhead mounted door holder assembly having a low profile suitable for mounting in a door top inset.

Temporarily holding a door in an open position is often necessary for convenience and safety. One commonly employed method uses an overhead mounted door control device that includes a pivoting arm attached between an upper portion of a door jamb and an upper part of a door. When the door is to be held open at an angle that does not exceed about 110 degrees, an overhead mounted door control device is efficient, effective, convenient to install and maintain, is less subject to damage by vandalism or accidents, and does not present a potential stumbling hazard.

However, many conventional overhead mounted door control devices are difficult to properly mount in an inset door top because of their thickness. The time consuming and expensive modifications to the door required to properly fit the door holder, can cause building managers to omit or postpone installation of door holders necessary for convenience or safety. Alternatively, marginal performance conventional low profile door holders may be attached, leading to dissatisfaction and high maintenance and replacement costs.

What is needed is an overhead door holder assembly that is durable, easy to install as an inset into the top of a door, and adjustable or replaceable with minimal effort and expertise. The door holder should be set to permit easy engagement to hold the door against minor jostling contacts, and yet still permit closing the door without undue effort. In addition, the door hold position should be easily selectable and act at any angle of door opening.

Such a door holder should not require special tools for installation or maintenance, and should have features to prevent damage from violent or forceful door opening. The door should automatically be held in an open position after it is swung open to a predetermined angle, and should allow for easy controllable release from its held open position when desired.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an adjustable overhead mounted door holder assembly, for attachment between a door jamb and a door, for selectively holding the door in an open position including a jamb bracket attached to the door jamb and a jamb arm pivotally attached to the jamb bracket; a channel assembly having a longitudinally extending, substantially straight channel defined within the channel assembly and attached to extend in parallel orientation with respect to the top of the door; with first and second friction springs for respectively urging first and second friction pads against the channel walls; and an adjustment assembly for varying friction force of the first and second friction pads against the channel walls, the adjustment assembly including a rotatable, eccentrically shaped friction cam positioned between the first and second friction springs.

The foregoing and other aspects will become apparent from the following detailed description of the invention when considered in conjunction with the accompanying drawing figures.

DETAILED DESCRIPTION OF THE INVENTION

Figure 1:
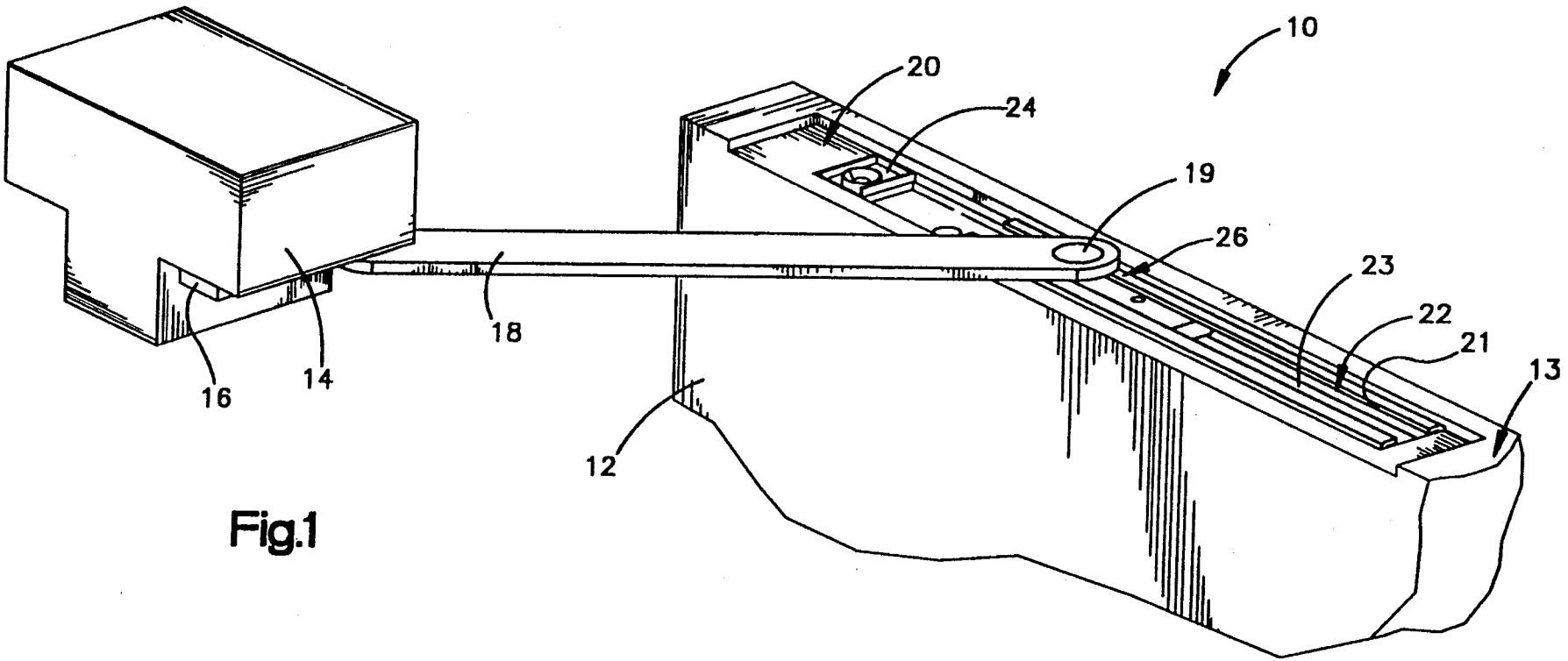
FIG. 1 is a perspective view of an adjustable overhead mounted door holder assembly that includes a channel assembly inset into a top of a door.

As illustrated in FIG. 1, an adjustable overhead door holder assembly 10 has a channel assembly 22 positioned in a door inset 20 at an upper edge 13 of a door 12. The channel assembly 22 is attached to the door 12 so that its longitudinally extending and generally U-shaped channel 23 is upwardly open. Positioned for sliding movement within the channel 23 is a slide assembly 26. The assembly 10 also includes a jamb bracket 16 permanently affixed to a door jamb 14. A jamb arm 18 is pivotally connected at one end to the jamb bracket 16 and at its opposite end to the slide assembly 26. In preferred embodiments, the jamb bracket 16, jamb arm 18 and channel assembly 22 are formed from brass or other durable, wear resistant material such as steel.

When the door 12 is closed with its upper edge 13 positioned parallel to and adjacent to the door jamb 14, the slide assembly 26 is positioned in the channel 23 distant from the spring support 24. As the door 12 is opened, as shown in FIG. 1, the pivoting connection of the jamb arm 18 between the jamb bracket 16 and the slide assembly 26 allows the slide assembly 26 to move along the channel 23 toward a spring support 24. When the door opening force is stopped or diminished, the static frictional force exerted by the slide assembly 26 against the channel walls holds the door in an open position at an infinitely selectable position from completely open to fully closed.

Figure 2:
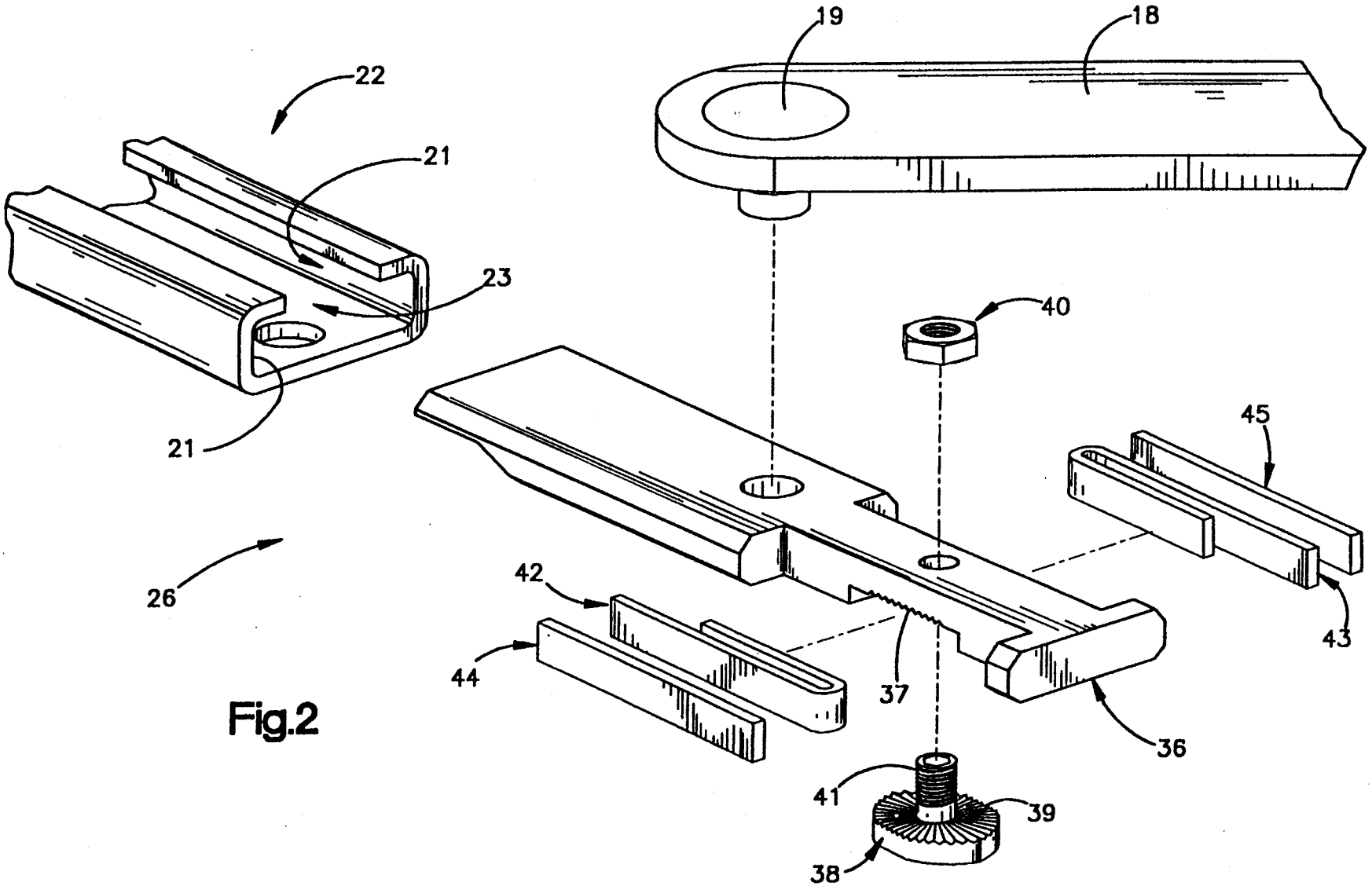
FIG. 2 is an exploded perspective view of a slide assembly, a channel assembly, and a jamb arm.

As best illustrated in FIG. 2, the slide assembly 26 includes a slider 36 having serrations 37 defined on it, first and second springs 42 and 43, first and second friction pads 44 and 45 (formed from brake lining or other wear and heat resistant material), and a friction cam 38 connected to the slider 36 by its shaft 41 and a nut 40, along with additional locking engagement being provided by matched locking of its serrations 39 and serrations 37 of the slider 36. The springs 42 and 43 have a generally U-shaped cross sectional shape, and are respectively positioned between the centrally located slider 36 and the first and second friction pads 44 and 45. When assembled, the springs 42 and 43 compress the pads 44 and 45 against the channel walls 21 of the channel assembly 22, the exact amount of compression being determined by the angle of rotation of the friction cam 38.

Figure 3:
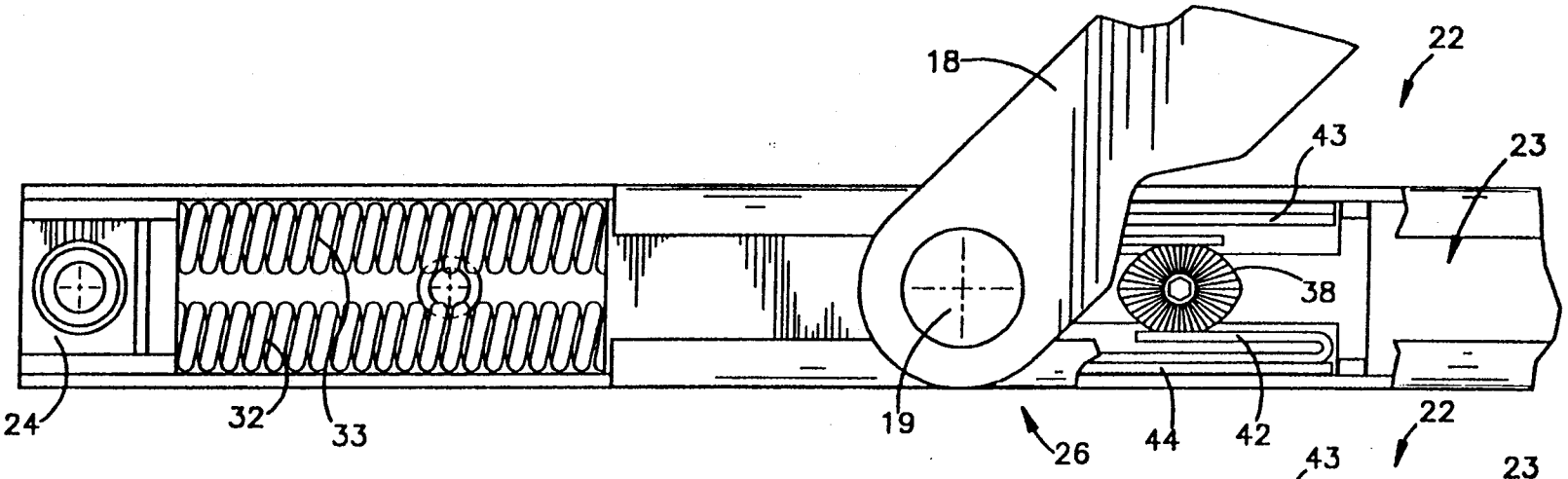
FIGS. 3, 4, and 5 illustrate a slide assembly seated in a channel assembly, with the friction cam rotated to a different position in each of the Figures.
Figure 4:
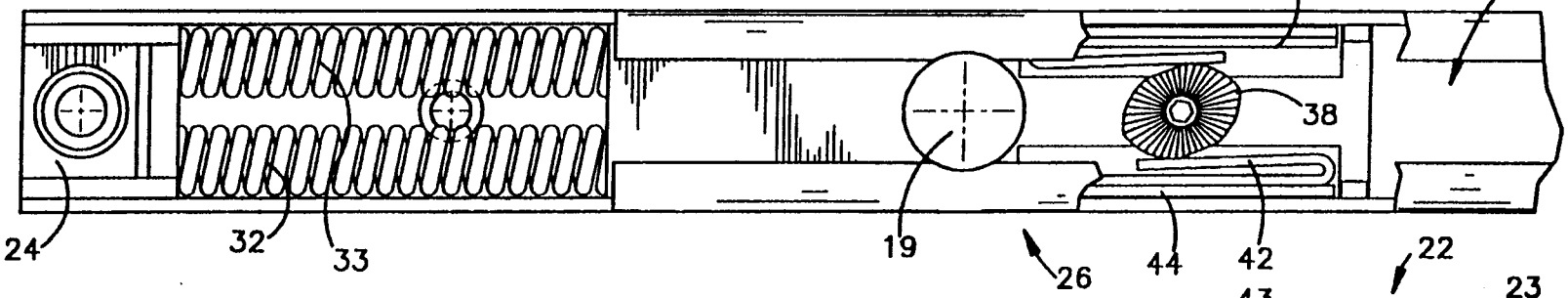
Figure 5:
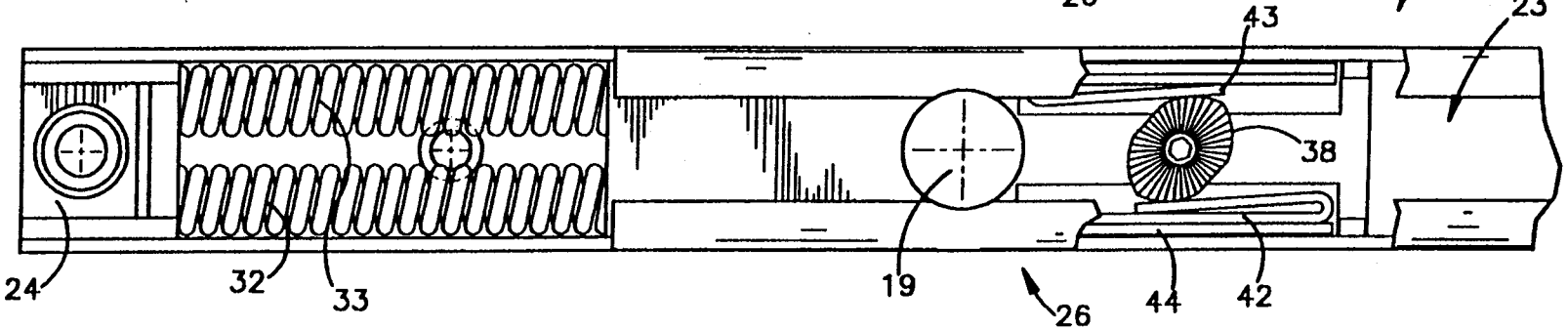

As seen in FIGS. 3, 4, and 5, the friction cam 38 has an elliptical cross section. As the cam 38 is rotated from a first position with the long axis of the ellipse parallel to the channel (as seen in FIG. 3) to an increasingly angled position with respect to the longitudinal axis of the channel assembly (FIGS. 4 and 5), the springs 42 and 43 are increasingly compressed. This compression of the springs 42 and 43 consequently results in greater static and dynamic frictional force exerted by the pads 43 and 44. Depending on the thickness, type of pad, door resistance, and other appropriate factors, the friction cam 38 can be adjusted to compress the springs a desired amount by adjusting its rotational angle. When the friction cam 38 is set at the correct rotational angle, it is slightly rocked so that the serrations 37 of the slider and serrations 39 of the friction cam 38 mesh, providing resistance to movement out of position as the nut 40 is tightened on the shaft 41. Using easily available tools, the present invention allows simple and quick adjustment of door hold force.

An additional aspect of the present invention is its capacity for forceful door opening impact reduction. As best illustrated in FIGS. 3, 4, and 5, when the door is opened far enough, the slide assembly 26 impacts and is slowed by contact with springs 32 and 33 held by a spring support 24 to longitudinally extend in parallel spaced apart relationship along the channel 23. By slowly distributing the force of door opening, the springs prevents shock damage to the assembly 10.

What is claimed is:

1. An adjustable overhead door holder assembly for attachment between a door jamb and a door for selectively holding the door, the assembly comprising a jamb bracket for attachment to a door jamb, a jamb arm pivotally attached to the jamb bracket, a channel assembly having channel walls defining a channel, a slide assembly positioned for movement in the channel assembly including a slider having plurality of serrations, the slide assembly being pivotally attached to the jamb arm, and having first and second friction springs respectively urging first and second friction pads against the channel walls, and an adjustment assembly for varying friction force of the first and second friction pads against the channel walls, the adjustment assembly comprising an eccentrically shaped friction cam positioned between the first and second friction springs, the friction cam including a plurality of serrations for locked engagement with the serrations on the slider.

2. The door holder assembly of claim 1, wherein the friction cam has an elliptical cross section.

3. The door holder assembly of claim 1, wherein the friction cam further comprises a threaded shaft held in locked position by a nut.

4. The door holder assembly of claim 1, wherein the first and second springs each have a U-shaped cross section.

5. The door holder assembly of claim 1, wherein a spring support is attached to the channel assembly at a fixed position within the channel, and first and second springs are attached to the spring support to resist compressive force of the slide assembly as the slide assembly approaches the spring support.

6. The door holder assembly of claim 5, wherein the first and second springs are longitudinally positioned in the channel in parallel, spaced apart relationship to each other, with both springs having substantially equal spring constants and resistance to compressive force.

7. An adjustable overhead door holder assembly for attachment between a door jamb and a door for selectively holding the door, the assembly comprising a jamb bracket for attachment to a door jamb, a jamb arm pivotally attached to the jamb bracket, a channel assembly having channel walls defining a channel, a slide assembly positioned for movement in the channel assembly, the slide assembly comprising a slider having a plurality of serrations, the slider being pivotally attached to the jamb arm, the slide assembly having first and second friction springs respectively urging first and second friction pads against the channel walls, and an adjustment assembly for varying friction force of the first and second friction pads against the channel walls, the adjustment assembly comprising an eccentrically shaped friction cam positioned between the first and second friction springs, the friction cam being configured to define a plurality of serrations for locked engagement with the serrations on the slider, the friction cam having a threaded shaft that can be held in locked position by a separately attachable nut after the serrations on the slider and the serrations on the friction cam are intermeshed in locking engagement.

8. An adjustable overhead door holder assembly for attachment between a door jamb and a door, the assembly comprising a jamb arm and means for pivotally attaching the jamb arm to a door jamb, a channel assembly for attachment to a door and having channel walls defining an upwardly opening channel, a door holding means positioned within the channel assembly, the door holding means comprising a slide assembly positioned for movement in the channel, the slide assembly including a slider having a plurality of serrations, the slider being pivotally attached to the jamb arm, the slide assembly having first and second friction springs respectively urging first and second friction pads against the channel walls, and an adjustment assembly for varying friction force of the first and second friction pads against the channel walls, the adjustment assembly comprising an eccentrically shaped friction cam positioned between the first and second friction springs having a plurality of serrations for locked engagement with the serrations on the slider.

9. The door holder assembly of claim 8, wherein the friction cam is configured to have an elliptical cross section.

10. The door holder assembly of claim 8, wherein the friction cam of the door holding means further comprises a threaded shaft held in locked position by a nut.

* * * * *